US006962131B2

(12) United States Patent
Aketa et al.

(10) Patent No.: US 6,962,131 B2
(45) Date of Patent: Nov. 8, 2005

(54) WATER COOLING DEVICE OF VERTICAL MULTI-CYLINDER ENGINE

(75) Inventors: Masahiro Aketa, Sakai (JP); Tetsuya Kosaka, Sakai (JP); Shigeyoshi Yamanaka, Sakai (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 10/242,542

(22) Filed: Sep. 12, 2002

(65) Prior Publication Data

US 2003/0056738 A1 Mar. 27, 2003

(30) Foreign Application Priority Data

Sep. 25, 2001 (JP) ..... P 2001-291439

(51) Int. Cl.[7] ..... F02B 75/18
(52) U.S. Cl. ..... 123/41.74; 123/54.4; 123/41.01
(58) Field of Search ..... 123/41.74, 41.79, 123/41.72, 41.01, 54.4

(56) References Cited

U.S. PATENT DOCUMENTS 4,530,315 A * 7/1985 Mezger ..... 123/41.74
4,665,867 A 5/1987 Iwamoto et al.
4,741,293 A * 5/1988 Itoh et al. ..... 123/41.79
5,915,346 A * 6/1999 Rehr ..... 123/41.74

FOREIGN PATENT DOCUMENTS

DE 1 220 203 6/1966

* cited by examiner

*Primary Examiner*—Tony M. Argenbright
*Assistant Examiner*—Katrina Harris
(74) *Attorney, Agent, or Firm*—Akin Gump Strauss Hauer & Feld, L.L.P.

(57) ABSTRACT

A water cooling device of a vertical multi-cylinder engine includes a cylinder block (1) one side wall of which is provided with a side water passage (3) running along a longitudinal direction of the cylinder block (1). The cylinder block (1) has an interior area provided with a cylinder jacket (4). Cooling water from a radiator is introduced into the cylinder jacket (4) through the side water passage (3). The side water passage (3) has an outlet (5) toward a lower portion of the cylinder jacket (4).

9 Claims, 7 Drawing Sheets

WATER COOLING DEVICE OF VERTICAL MULTI-CYLINDER ENGINE

BACKGROUND OF THE INVENTION

1. Field of the Invention

The present invention relates to a water cooling device of a vertical multi-cylinder engine.

2. Description of Prior Art

A conventional example of the water cooling device of the vertical multi-cylinder engine has a cylinder block one side wall of which is provided with a side water passage extending along a longitudinal direction of the cylinder block, like the present invention. The cylinder block has an interior space provided with a cylinder jacket, into which cooling water from a radiator is introduced through the side water passage.

Conventionally, the engine of this type has an outlet of the side water passage opposed to an upper portion of the cylinder jacket.

The conventional technique has the following problems.

(Problem) Each cylinder wall has an upper and a lower portions warmed and cooled ununiformly.

The side water passage has its outlet opposed to an upper portion of the cylinder jacket. A large amount of cooling water which has flowed out of the outlet of the side water passage enters into the upper portion of the cylinder jacket without passing a lower portion of the cylinder jacket. And the cooling water dwells at the lower portion of the cylinder jacket to result in ununiformly warming or cooling the upper and lower portions of each cylinder wall. Thus, in warm operation, each cylinder wall has its lower side portion hardly warmed to result in a likelihood of seizing a piston. Further, in normal operation, each cylinder wall has a lower side portion insufficiently cooled. This results in producing a gap between the lower side portion and a piston ring to easily cause a blow-by gas leakage and an oil rise-up into a combustion chamber.

SUMMARY OF THE INVENTION

The present invention has an object to provide a water cooling device of a vertical multi-cylinder engine, which can solve the foregoing problems.

An invention of claim 1 is constructed as follows.

As shown in FIG. 1, a water cooling device of a vertical multi-cylinder engine comprises a cylinder block 1, one side of which is provided with a side water passage 3 running along a longitudinal direction of the cylinder block 1. The cylinder block 1 has an interior area provided with a cylinder jacket 4, into which cooling water from a radiator is introduced through the side water passage 3. The side water passage has an outlet 5 opposed to a lower portion of the cylinder jacket 4.

The invention of claim 1 offers the following effect.

(Effect 1) Each cylinder wall has an upper and a lower portions uniformly warmed and cooled.

As shown in FIG. 1, the side water passage 3 has its outlet 5 opposed to the lower portion of the cylinder jacket 4. Therefore, cooling water which has flowed out of the outlet 5 of the side water passage 3 passes through the lower portion of the cylinder jacket 4 and then floats up to the upper portion of the cylinder jacket 4. This results in warming and cooling the upper and lower portions of each cylinder wall uniformly. Therefore, in warm operation, each cylinder wall 12 has its lower side portion warmed as well as its upper side portion with the result of hardly seizing a piston 24. Further, in normal operation, each cylinder wall 12 has its lower side portion fully cooled as well as its upper side portion to result in hardly producing a gap between the lower side portion and a piston ring. This hardly causes the blow-by gas leakage and the oil rise-up into the combustion chamber.

An invention of claim 2 offers the following effect.

(Effect 2) It is possible to reduce a horizontal width of an engine.

As shown in FIG. 1, the side water passage 3 and a pair of upper and lower shafts 6, 7 are arranged vertically along the cylinder jacket 4 and the cylinder wall 12. This can reduce a width dimension of the engine when compared with the case where these are arranged widthwise.

The invention of claim 3 offers the following effect 2.

(Effect 3) It is possible to decrease a water passage resistance.

As shown in FIG. 2, a water pump 10 is attached to an end opposite to a timing transmission device 8. As shown in FIG. 7, the cylinder block 1 has an end wall 9 opened to provide an inlet 11 of the side water passage 3, which faces a discharge port of the water pump 10. Therefore, when communicating the inlet 11 of the side water passage 3 with the discharge port of the water pump 10, the inlet 11 can directly face the discharge port without bypassing a side of the timing transmission device 8 to result in the possibility of decreasing the water passage resistance.

The invention of claim 4 offers the following effect.

(Effect 4) All cylinder walls are warmed and cooled uniformly.

As shown in FIG. 3, the side water passage 3 which passes by all the cylinder walls 12 is provided with a plurality of outlets 5. The outlets 5 are arranged at both ends and at a mid portion in a longitudinal direction of the side water passage 3. This distributes the cooling water evenly toward all the cylinder walls 12 to uniformly warm and cool all the cylinder walls 12.

The invention of claim 5 offers the following effect.

(Effect 5) It is possible to reduce the horizontal width of the engine.

As shown in FIG. 3, a tappet guide hole 14 of a valve operating device is provided in a wall 13 between adjacent outlets 5, 5 of the side water passage 3. This can reduce the horizontal width of the engine when compared with a case where the outlets 5 and the tappet guide hole 14 are arranged side by side widthwise.

The invention of claim 6 offers the following effect.

(Effect 6) Each cylinder wall has a front and a rear portions warmed and cooled uniformly.

As shown in FIG. 3, the respective outlets 5 of the side water passage 3 oppose to end surfaces projecting laterally of the respective cylinder walls 12. When assuming the longitudinal direction of the cylinder block 1 as a front and rear direction, cooling water which has flowed horizontally from the respective outlets 5 of the side water passage 3 into the cylinder jacket 4 butts against the end surfaces 15 of the respective cylinder wall 12 to be evenly divided in the front and rear direction with the result of warming and cooling the front and rear portions of each cylinder wall 12 uniformly.

The invention of claim 7 offers the following effect.

(Effect 7) A connection wall between cylinder bores is cooled with a high efficiency.

As shown in FIGS. 3 and 4, when connecting adjacent cylinder walls 12, 12 to each other, a connection wall 16 therebetween is formed with an inter-cylinder transverse passage 17 which runs along a width direction of the cylinder block 1. When the width direction of the cylinder block 1 is seen as a horizontal direction, cooling water which has horizontally flowed from the outlet 5 of the side water passage 3 into the cylinder jacket 4 is pushed into the inter-cylinder transverse passage 17. This enables the cooling water to smoothly pass the inter-cylinder transverse passage 17, thereby enhancing the cooling efficiency of the connection wall 16 between the cylinder bores.

The invention of claim 8 offers the following effect.

(Effect 8) An engine has both sides warmed and cooled uniformly.

As shown in FIG. 7, cooling water which has crossed the inter-cylinder transverse passage 17 is reversed to cross an inter-port transverse passage 21, which results in uniformly warming and cooling both sides of the engine.

The invention of claim 9 offers the following effect.

(Effect 9) Whole engine is warmed and cooled uniformly.

As shown in FIG. 7, cooling water crosses the interior area of the cylinder block 1 and circulates within the cylinder head 18 vertically and horizontally without leaving any room to result in uniformly warming and cooling the whole engine.

The invention of claim 9 offers the following effect.

(Effect 10) Intake air is filled with a high efficiency.

As shown in FIG. 7, cooling water which passes through the inter-port transverse passage 21 is directed from an intake air distributing means 22 on one side of the cylinder head 18 to an exhaust gas merging means 23 on the other side. The exhaust heat is hardly transmitted to the intake air distributing means 22 to thereby inhibit the intake air from increasing its temperature. This results in a high filling efficiency of the intake air.

BRIEF DESCRIPTION OF THE DRAWINGS

FIG. 5(A) is a plan view in cross section and FIG. 5(B) is a sectional view of FIG. 5(A) along a line B—B;

FIG. 6 shows the cylinder head in FIG. 5.

DESCRIPTION OF THE PREFERRED EMBODIMENTS

Explanation is given for an embodiment of the present invention based on the drawings. FIGS. 1 to 7 explains an embodiment of the present invention. In this embodiment, explanation is given for a water-cooled vertical multi-cylinder diesel engine.

This engine is outlined as follows.

Figure 2:
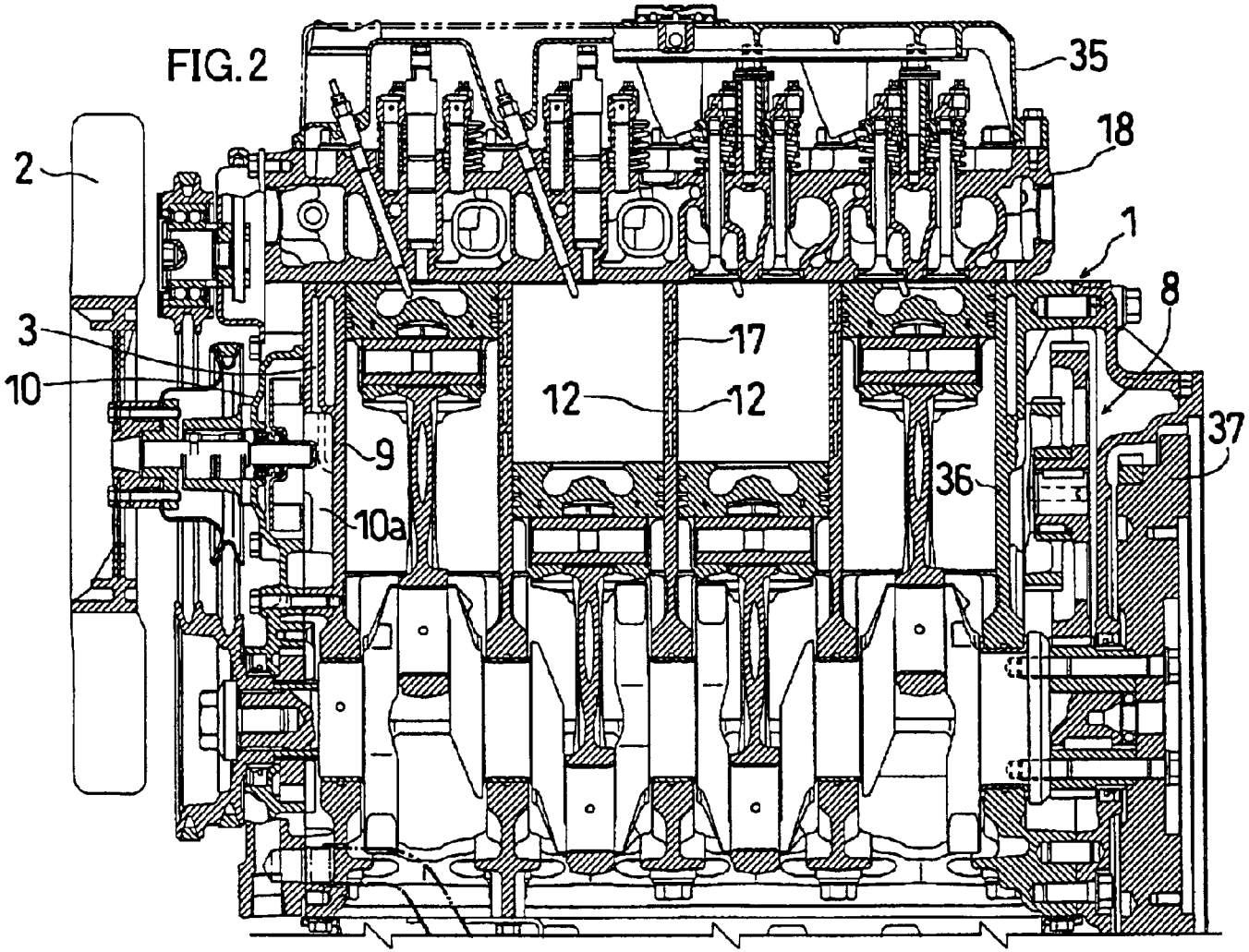
FIG. 2 is a vertical sectional side view of the engine shown in FIG. 1.
Figure 3:
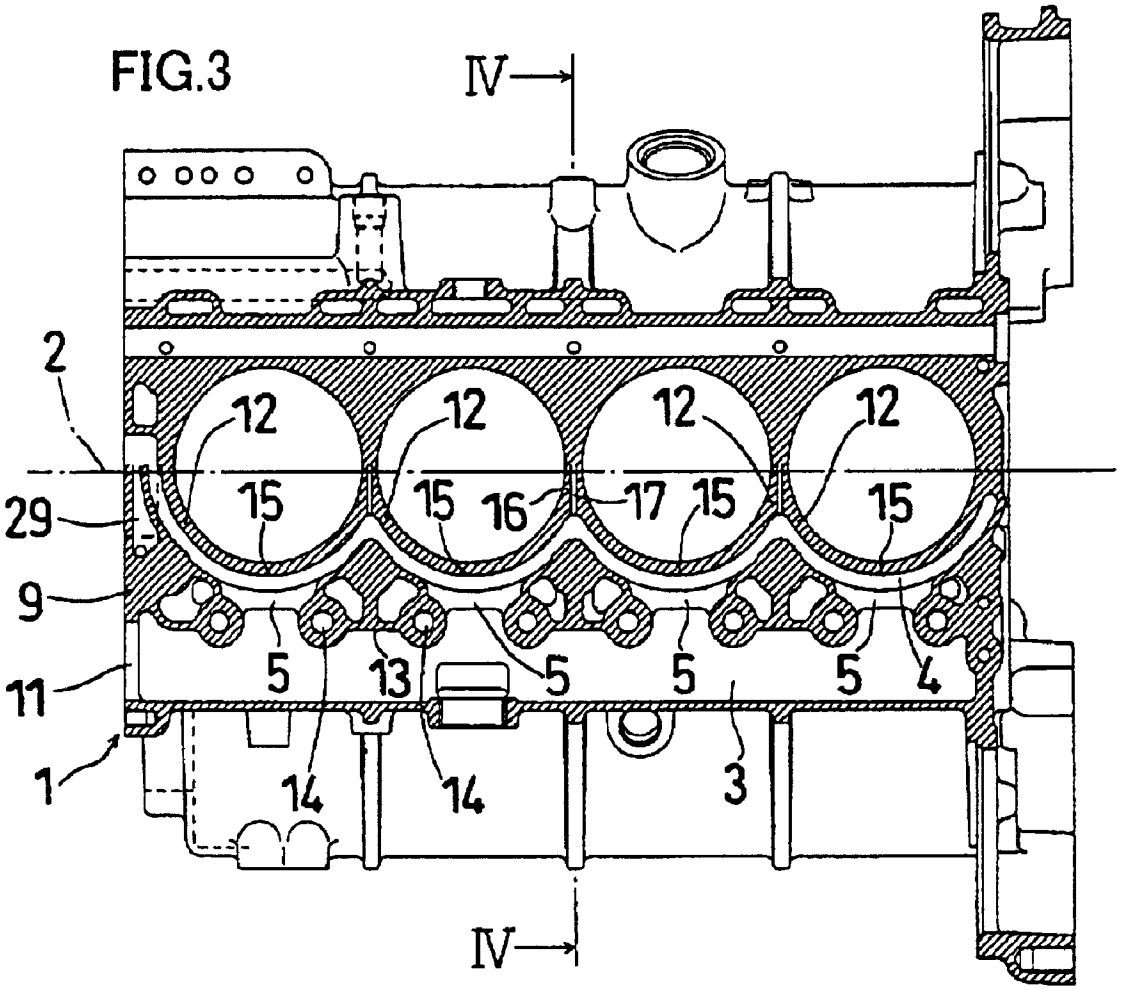
FIG. 3 is a plan view, in cross section, of a cylinder block of the engine in FIG. 1 and shows left and right portions bordered by a cylinder center axis 2 cut at different portions.

As shown in FIG. 2, a cylinder block 1 has an upper portion to which a cylinder head 18 is assembled. A head cover 35 is assembled to an upper portion of the cylinder head 18. The cylinder block 1 has a front end wall 9 to which a water pump 10 having a cooling fan 2 is attached. The cylinder block 1 has a rear end portion where a fly wheel 37 is arranged. As shown in FIG. 3, the cylinder block 1 has a right side wall provided with a side water passage 3 which runs along a front and rear direction of the cylinder block 1. Cooling water from a radiator is introduced into a cylinder jacket 4 through the side water passage 3.

A relationship of the water pump 10 with the side water passage 3 is as follows.

Figure 7:
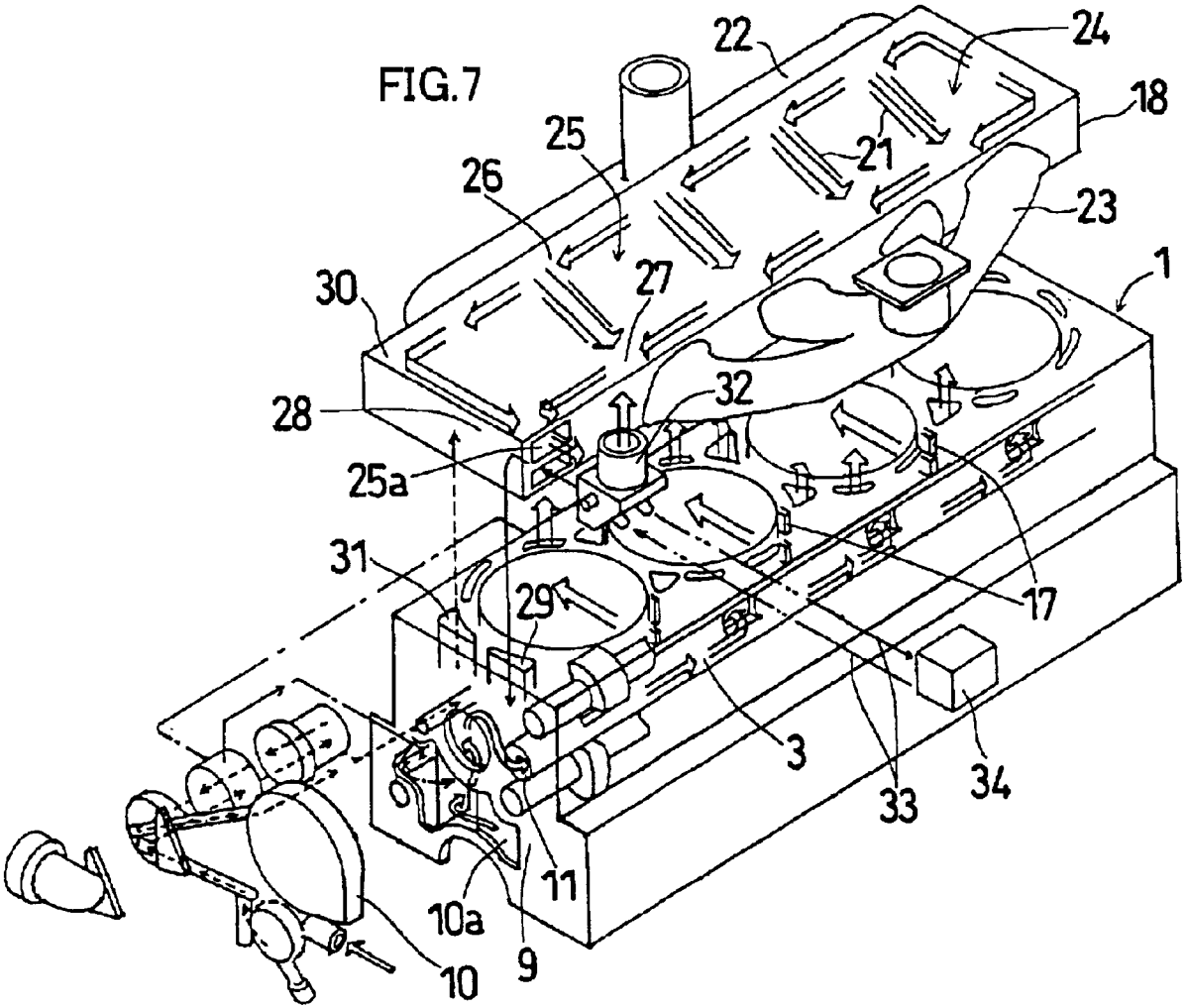
FIG. 7 is a schematic perspective view which shows a flow of cooling water in the engine of FIG. 1.

As shown in FIG. 3, the cylinder block 1 has the front end wall 9 opened to provide an inlet 11 of the side water passage 3. As shown in FIG. 7, the side water passage 3 has the inlet 11 opposed to a discharge port of the water pump 10. As shown in FIG. 2, there is arranged a timing transmission device 8 between a rear end wall 36 and the fly wheel 37 of the cylinder block 1. As such, the timing transmission device 8 is arranged at the rear end portion of the cylinder block 1. Therefore, the water pump 10 can be arranged without being interrupted by the timing transmission device 8. This can lower a position of the cooling fan 2 attached to the water pump 10 and can hardly restrict the type of the machine to which the engine is loaded. The timing transmission device 8 is a timing gear train.

The side water passage 3 is constructed as follows.

Figure 1:
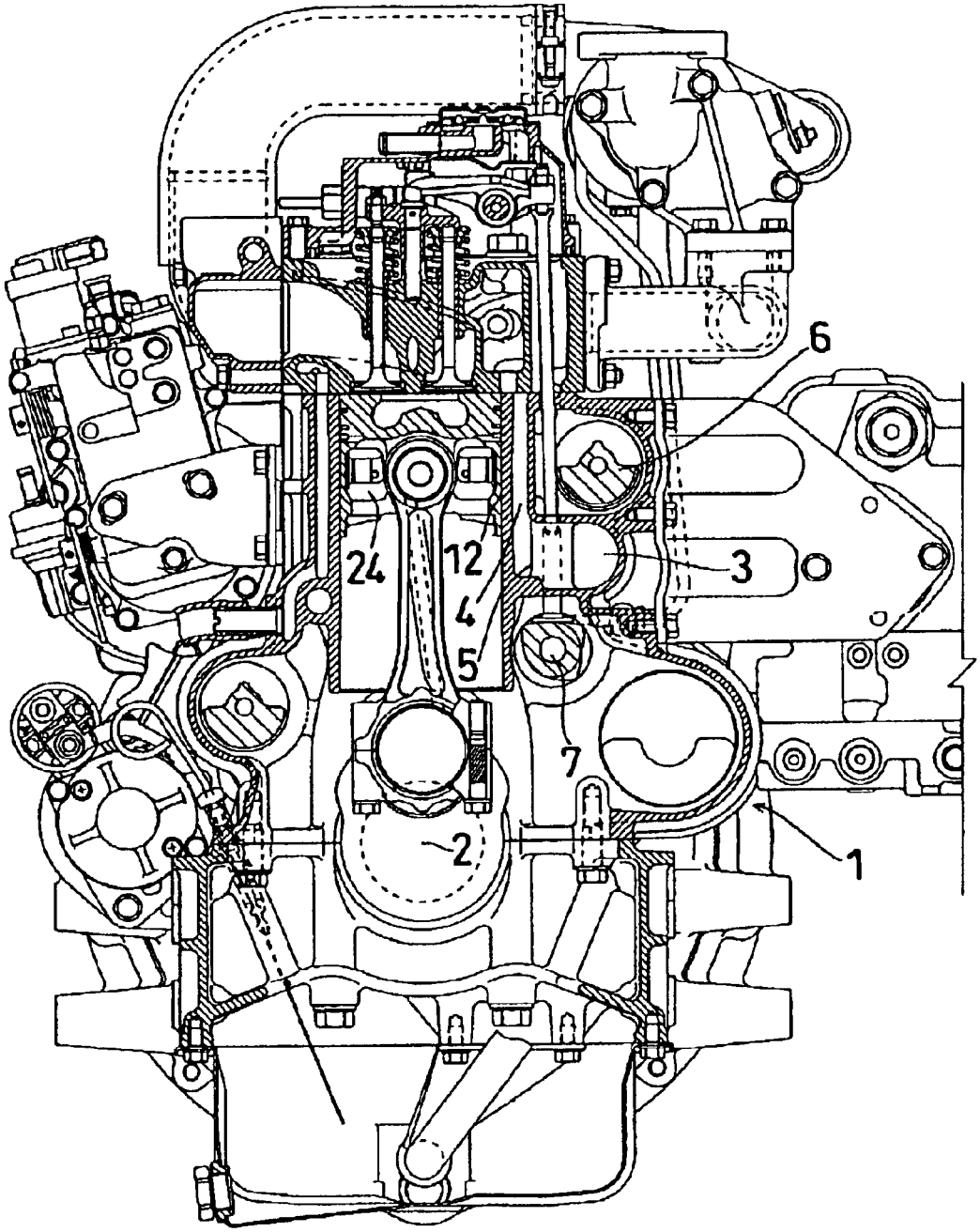
FIG. 1 is a vertical sectional view of an engine according to an embodiment of the present invention.

As shown in FIG. 1, when arranging the side water passage 3 with a pair of upper and lower shafts 6, 7 on a right side of the cylinder block 1, the side water passage 3 and the pair of upper and lower shafts 6, 7 are vertically arranged along the cylinder jacket 4 and the cylinder wall 12. This can reduce a width dimension of the engine when compared with a case where these are arranged in a width direction. The upper shaft 6 of the side water passage 3 is a secondary balancer shaft and the lower shaft 7 of the side water passage 3 is a valve operating cam shaft. A left shaft 38 of the cylinder block 3 is another secondary balancer shaft.

As shown in FIG. 3, the side water passage 3 extends over the entire length of the cylinder block 1 and passes by all the cylinder walls 12. The side water passage 3 is provided with a plurality of outlets 5. The outlets 5 are arranged at both ends of the side water passage 3 as well as at a mid portion thereof. The respective outlets 5 face end surfaces projecting laterally of the respective cylinder walls 12. Thus cooling water is evenly distributed toward all the cylinder walls 12 to result in warming and cooling all the cylinder walls 12 uniformly. Cooling water horizontally flows from the respective outlets 5 of the side water passage 3 into the cylinder jacket 4. The thus flowed-in cooling water butts against the laterally projecting end surfaces 15 of the respective cylinder walls 12 to be evenly divided in the front and rear direction with the result of uniformly warming and cooling the front and rear portions of the respective cylinder walls 12. Further, a tappet guide hole 14 of the valve operating device is provided within a wall 13 between adjacent outlets 5, 5 of the side water passage 3. This can reduce the horizontal width of the engine when compared with a case where the outlets 5 and the tappet guide hole 14 are arranged widthwise.

As shown in FIG. 1, the side water passage 3 has the outlets 5 opposed to a lower portion of the cylinder jacket 4. Thus the cooling water which has flowed out of the outlets 5 of the side water passage 3 passes by the lower portion of the cylinder jacket 4 and then floats up to an upper portion of the cylinder jacket 4, thereby uniformly warming and cooling the upper and lower portions of the respective cylinder walls 12. Accordingly, in warm operation, each cylinder wall 12 has its lower side portion warmed as well as it supper side portion to thereby hardly cause the seizure of a piston 24. In normal operation, each cylinder wall 12 has its upper side portion fully cooled as well as its lower side portion to thereby hardly produce a gap between the lower side portion and a piston ring. Thus the blow-by gas leakage hardly occurs as well as the oil rise-up to the combustion chamber.

The cylinder jacket 4 is constructed as follows.

Figure 4:
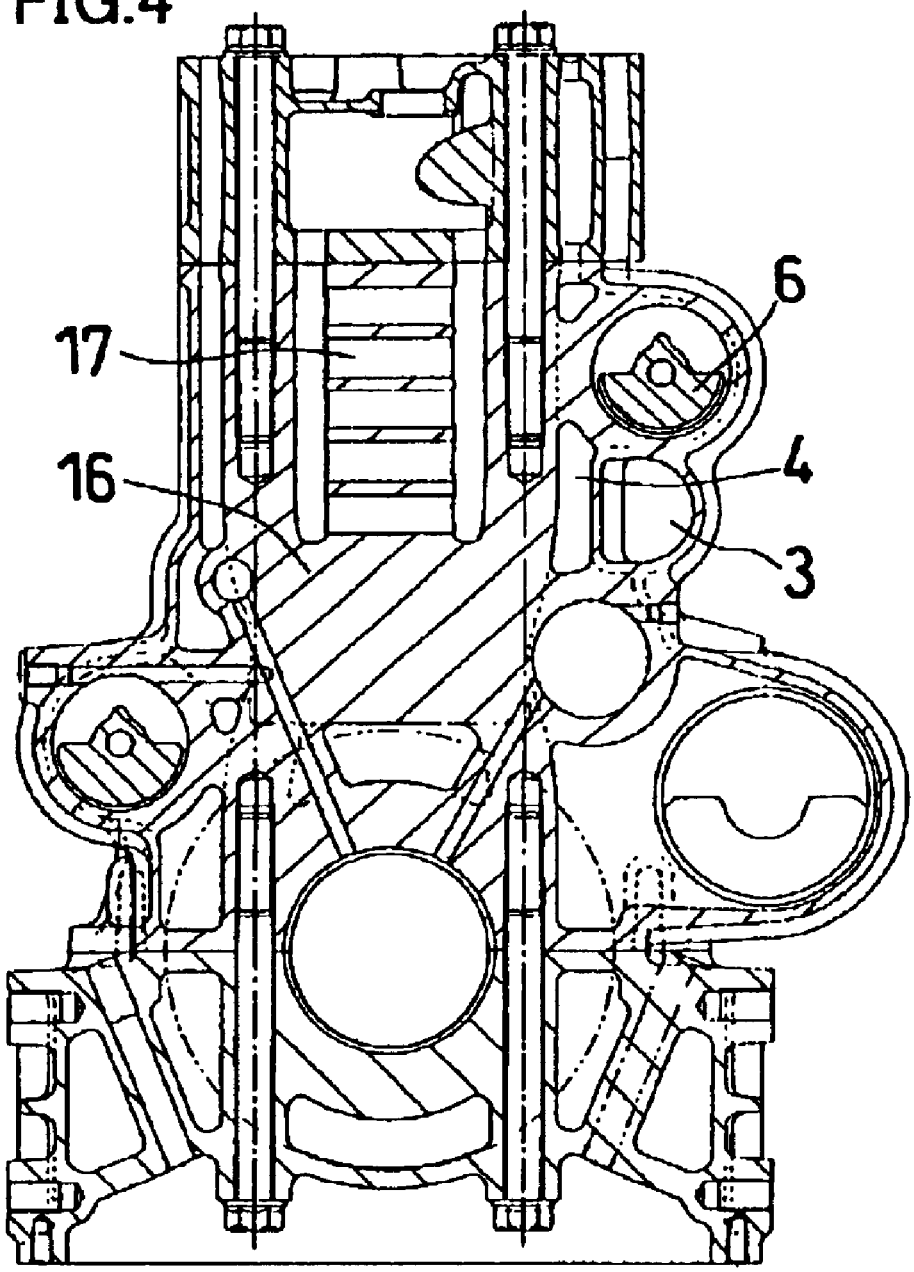
FIG. 4 shows the cylinder block of FIG. 3 in section along a line IV—IV.

As shown in FIGS. 2 to 4, in the cylinder block 1, adjacent cylinder walls 12, 12 are mutually connected to form a connection wall 16. The connection wall 16 is formed with an inter-cylinder transverse passage 17 which runs along the width direction of the cylinder block 1. Thus when the width direction of the cylinder block 1 is assumed as a horizontal direction, cooling water which has horizontally flowed from the outlets 5 of the side water passage 3 to the cylinder jacket 4 is pushed into the inter-cylinder transverse passage 17. This enables the cooling water to smoothly pass through the inter-cylinder transverse passage 17, thereby enhancing the cooling efficiency of the connection wall 16 between the cylinder bores.

The head jacket 25 is constructed as follows.

Figure 5:
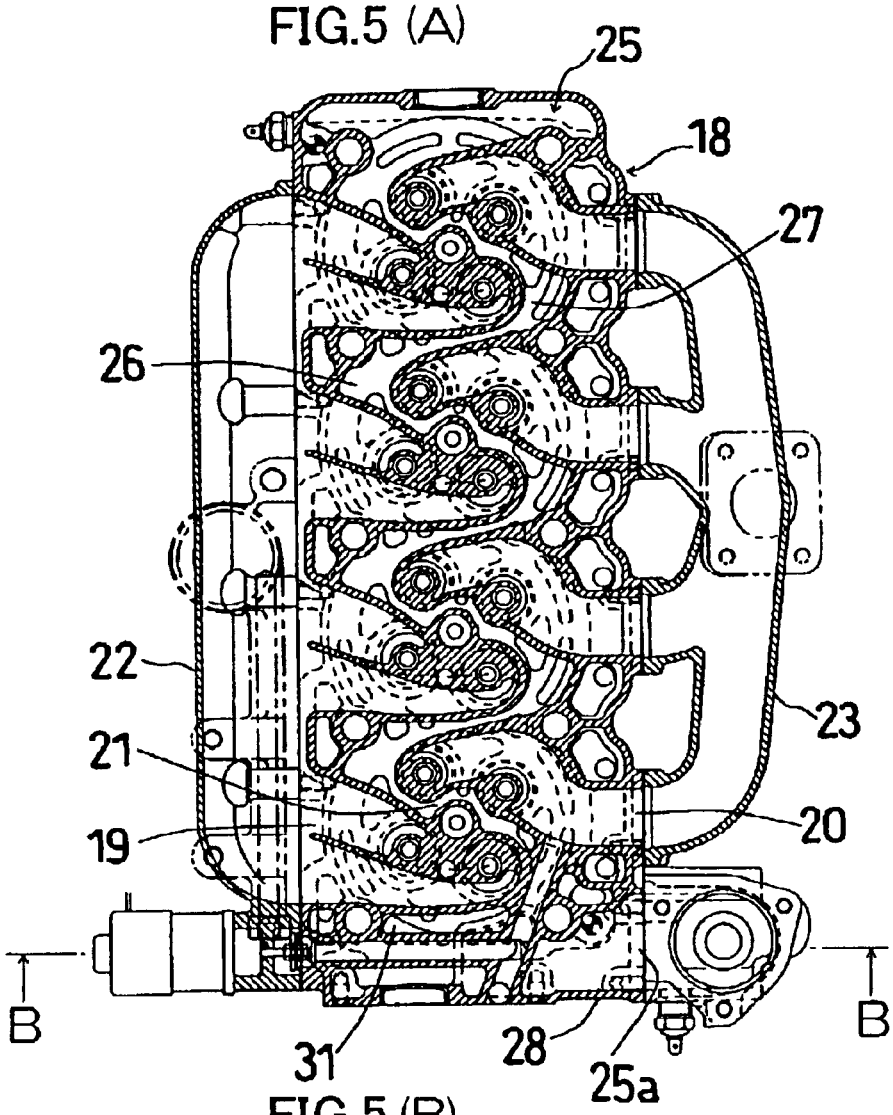
FIG. 5 shows a cylinder head of the engine in FIG. 1.
Figure 5:
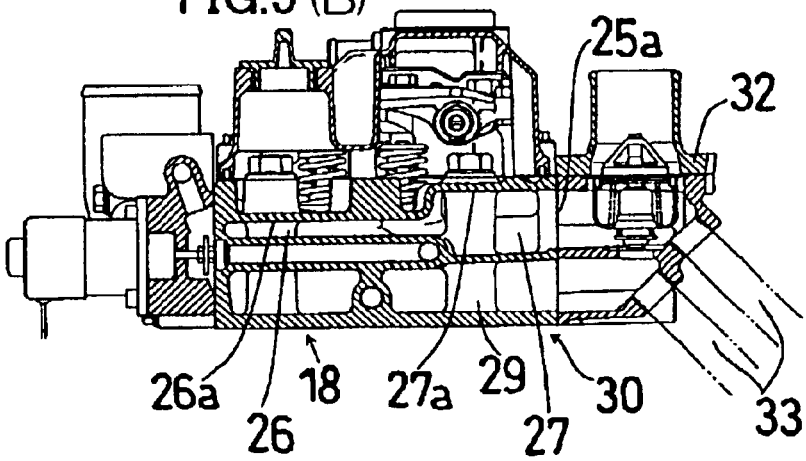
Figure 6A:
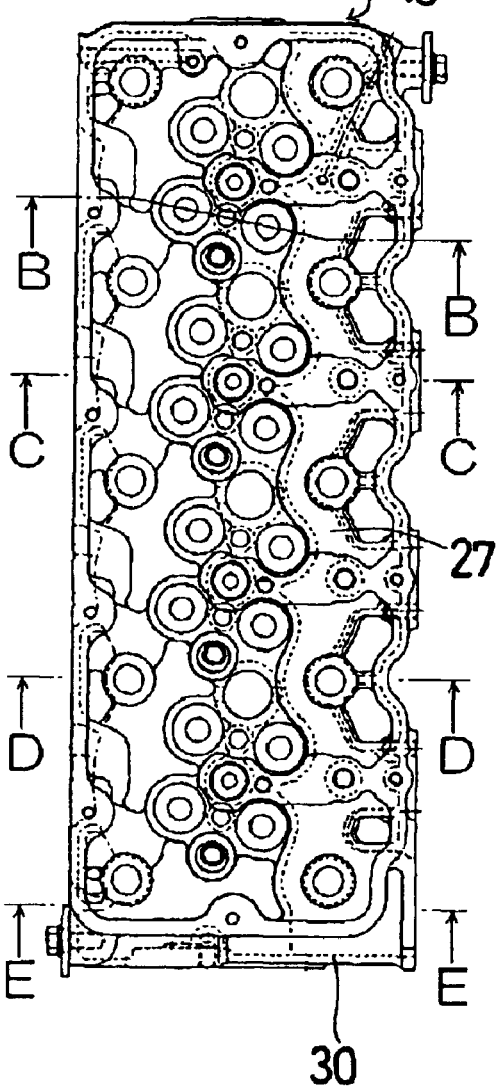
FIG. 6(A) is a plan view.
Figure 6B:
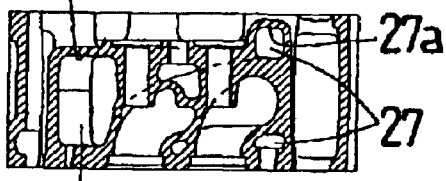
FIG. 6(B) is a sectional view of FIG. 6(A) along a line B—B.
Figure 6C:
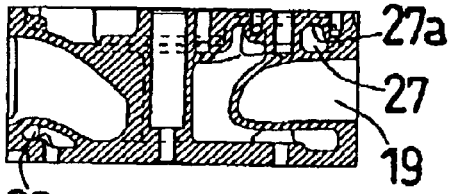
FIG. 6(C) is a sectional view of FIG. 6(A) along a line C—C.
Figure 6D:
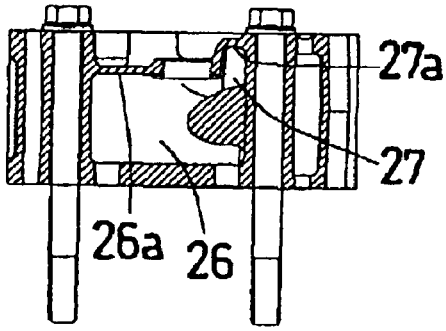
FIG. 6(D) is a sectional view of FIG. 6(A) along a line D—D.
Figure 6E:
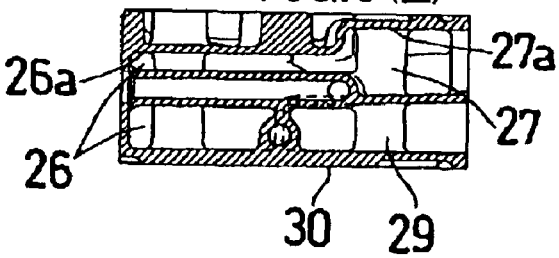
FIG. 6(E) is a sectional view of FIG. 6(A) along a line E—E.

As shown in FIGS. 5 and 6, the cylinder head 18 has an interior area provided with a head jacket 25. The cylinder head 18 has an intake port 19 and an exhaust port 20. Formed between the intake port 19 and the exhaust port 20 is an inter-port transverse passage 21 which runs along the width direction of the cylinder head 18. A head intake side water passage 26 is arranged near the intake air distributing means 22 of the cylinder head 18 and a head exhaust side water passage 27 is formed near an exhaust gas merging means 23 along a longitudinal direction of the cylinder head 18. The head intake side water passage 26 communicates with the head exhaust side water passage 27 through the inter-port transverse passage 21.

The cooling water flows as follows.

As shown in FIG. 7, part of the cooling water which has flowed from the side water passage 3 to a right side of the cylinder jacket 4 floats up to the head exhaust side passage 27 and the remainder flows into the inter-cylinder transverse water passage 17. A right and front corner portion 28 of the cylinder head 18 has a right side surface opened to provide an outlet 25*a* of the head jacket 25. Therefore, the cooling water crosses the inter-cylinder transverse water passage 17 from the side water passage 3 to the other side and then floats up to the head intake side water passage 26. While the floating up cooling water is passing through the head intake side passage 26 forwardly, it is divided into a plurality of inter-port transverse passages. While the divided cooling water is merging at the head exhaust water passage 27 near the side water passage 3, it passes through the water passage 27 forwardly. The cooling water which has passed through the both water passages forwardly merges and flows out of the outlet 25*a* of the head jacket 25. As such, the cooling water crosses the interior area of the cylinder block 1 and circulates vertically and horizontally without leaving any room within the cylinder head 18 to thereby warm and cool the whole engine uniformly. Further, the cooling water which passes through the inter-port transverse passage 21 flows from the intake air distributing means 22 on one side of the cylinder head 18 to the exhaust gas merging means 23 on the other side thereof, thereby making it hard for the exhaust heat to be transmitted to the intake air distributing means 22 with the result of being able to inhibit the intake air from increasing its temperature. This leads to a high filling efficiency of intake air. In the event that the side water passage 3 is arranged on a left side of the cylinder block 1 and the outlet 25*a* of the head jacket 25 is provided by opening a left side surface of the cylinder head 18, the cooling water flows in a manner symmetric to the above.

The head exhaust side passage 27 is constructed as follows.

As shown in FIG. 6(B) to FIG. 6(E), the head exhaust side water passage 27 has a ceiling wall lower surface 27*a* made higher than a ceiling wall lower surface 26*a* of the head intake side water passage 26. This inclines the engine in a right and left direction to make the head exhaust side water passage 27 higher. Then even if air pool is produced at the lower surface 27*a*, the exhaust port 19 has its ceiling wall hardly disclosed from the cooling water to result in the possibility of securing the cooling. The head exhaust side water passage 27 which runs along the longitudinal direction of the cylinder head 18 has made its ceiling wall lower surface 27*a* higher. Therefore, when the engine is inclined in the front and rear direction, the exhaust side water passage 27 has made its front end portion or its rear end portion higher to produce air pool at the front end of the ceiling wall lower surface 27 or at the rear end thereof, the exhaust port 19 at the front end or the rear end has its ceiling wall hardly disclosed from the cooling water to result in the possibility of securing the cooling.

The other water passages are constructed as follows.

As shown in FIG. 2, the water pump 10 has an inlet water passage 10*a* formed in a wall of a front end wall 9 of the cylinder block 1. As shown in FIG. 7, a by-pass passage 29 bypasses cooling water from a thermostat case 32 to the water pump 10. A deaerating passage 31 deaerates from the water pump 10 to the head jacket 25. Either of the by-pass passage 29 and the deaerating passage 31 spans from an interior area of the front end wall 9 of the cylinder block 1 to an interior area of a front end portion 30 of the cylinder head 18. Further, a thermostat case 32 is attached to the right side surface of the cylinder head 18. The thermostat case 32 is employed by connecting thereto a hot water pipe for a heat exchanger 33. Accordingly, there is no likelihood these project forwardly of the front end wall 9 of the cylinder block 1. The cooling fan 2 can approach to the cylinder block 1 without being interrupted by them to result in the possibility of shortening the entire length of the engine.

What is claimed is:

1. A water cooling device of a vertical multi-cylinder engine comprising a cylinder block (1) which has one side wall provided with a side water passage (3) running along a longitudinal direction of the cylinder block (1), and has an interior area provided with a cylinder jacket (4), into which cooling water from a radiator is introduced through the side water passage (3), wherein the side water passage (3) has an outlet (5) toward a lower portion of the cylinder jacket (4), and when disposing the water passage (3) together with a pair of upper and lower shafts (6), (7), the water passage (3) is arranged with the pair of upper and lower shafts (6), (7) vertically along the cylinder jacket (4) and a cylinder wall (12).

2. A water cooling device of a vertical multi-cylinder comprising a cyclinder block (1) which has one side wall provided with a side water passage (3) running along a longitudinal direction of the cylinder block (1), and has an interior area provided with a cylinder jacket (4), into which cooling water from a radiator is introduced through the side water passage (3), wherein the side water passage (3) has an outlet (5) toward a lower portion of the cylinder jacket (4), and a timing transmission device (8) is disposed at one end in the longitudinal direction of the cylinder bloc (1) and a water pump (10) is attached to an end wall (9) of the cylinder block (1) at the other end, the end wall (9) of the cylinder block (1) being opened to provide an inlet (11) of the side water passage (3), the inlet (11) of the side water passage (3) facing a discharge port of the water pump (10).

3. The water cooling device of the vertical multi-cylinder engine as set forth in claim 2, wherein the side water passage (3) which passes by all cyliner wall (12) is provided with a plurality of outlets (5), the plurality of outlets (5) being arranged at opposite ends and a mid portion in a longitudinal direction of the side water passage (3).

4. The water cooling device of the vertical multi-cylinder engine as set forth in claim 3, wherein a tappet guide hole (14) of a valve operating device is provided in a wall (13) between adjacent outlets (5), (5) of the side water passage (3).

5. The water cooling device of the vertical multi-cylinder engine as set forth in claim 3, wherein the side water passage (3) has outlets (5), the respective ones of which oppose to end surfaces projecting laterally of the respective cylinder walls (12).

6. A water cooling device of a vertical multi-cylinder comprising a cylinder block (1) which has one side wall provided with a side water passage (3) running along a longitudinal direction of the cylinder block (1), and has an interior area provided with a cylinder jacket (4) into which cooling water from a radiator is introduced through the side water passage (3), wherein the side water passage (3) has an outlet (5) toward a lower portion of the cylinder jacket (4), and when connecting adjacent cylinder walls (12), (12) through a connection wall (16), the connector wall (16) is formed with an inter- cylinder transverse passage (17) which runs along a width direction of the cylinder block (1).

7. The water cooling device of the vertical multi-cylinder engine as set forth in claim 6, wherein a cylinder head (18) has an interior area provided with a head jacket (25), and has an intake port (19) and an exhaust port (20), an inter-port transverse passage (21) being formed between the intake port (19) and the exhaust port (20) along a width direction of the cylinder head 18, cooling water which has crossed the inter-cylinder transverse passage (17) being reversed to cross the inter-port transverse passage (21).

8. The water cooling device of the vertical multi-cylinder engine as set forth in claim 7, wherein a head intake side water passage (26) is arranged near an intake air distributing means (22) of the cylinder head (18) and a head exhaust side water passage (27) is formed near an exhaust gas merging means (23), respectively, in a longitudinal direction of the cylinder head (18), the head intake side water passage (26) communicating with the head exhaust side water passage (27) through the inter-port transverse passage (21), cooling water which has crossed the inier-cylinder transverse passage (17) from the side water passage (3) to the other side floating up to the passage (26) opposite to the side water passage (3), which is one of the head intake side water passage (26) and the head exhaust side water passage (27), while the floating-up cooling water is passing through the water passage (26) forwardly, it being divided into a plurality of inter-port transverse passages (21), while the divided cooling water is merging at the water passage (27) on the side of the side water passage (3), it being passing through the water passage (27) forwardly, the cooling water which has forwardly passed the both water passages (26), (27) merging and flowing out of the outlet (25*a*) of the head jacket (25).

9. The water cooling device of the vertical multi-cylinder engine as set forth in claim 7, wherein cooling water which crosses the inter-port transverse passage (21) is directed from the intake air distributing means (22) on one side of the cylinder head (18) to the exhaust gas merging means (23) on the other side thereof.

* * * * *